US012655761B2

(12) United States Patent
McQuerrey

(10) Patent No.: US 12,655,761 B2
(45) Date of Patent: Jun. 16, 2026

(54) AUTONOMOUS ROOF BOLTER WITH SENSOR AND RELATED METHODS

(71) Applicant: J.H. FLETCHER & CO., Huntington, WV (US)

(72) Inventor: Sean Joseph McQuerrey, Huntington, WV (US)

(73) Assignee: J.H. FLETCHER & CO., Huntington, WV (US)

( * ) Notice: Subject to any disclaimer, the term of this patent is extended or adjusted under 35 U.S.C. 154(b) by 247 days.

(21) Appl. No.: 18/028,864

(22) PCT Filed: Sep. 28, 2021

(86) PCT No.: PCT/US2021/052265
§ 371 (c)(1),
(2) Date: Mar. 28, 2023

(87) PCT Pub. No.: WO2022/067218
PCT Pub. Date: Mar. 31, 2022

(65) Prior Publication Data

US 2023/0349292 A1 Nov. 2, 2023

Related U.S. Application Data

(60) Provisional application No. 63/084,238, filed on Sep. 28, 2020.

(51) Int. Cl.
*E21D 20/00* (2006.01)

(52) U.S. Cl.
CPC ..... *E21D 20/003* (2013.01)

(58) Field of Classification Search
CPC ..... E21D 20/003; E21D 9/003; E21D 9/004; E21B 7/022; E21B 44/00; G05D 1/0274; E21C 35/24
See application file for complete search history.

(56) References Cited

U.S. PATENT DOCUMENTS 3,218,893 A 11/1965 Madison et al.
5,060,735 A * 10/1991 Ågren ..... E21B 7/022 173/39
11,002,075 B1 * 5/2021 McQuerrey ..... E21D 9/003
(Continued)

FOREIGN PATENT DOCUMENTS

CN 204663559 U 9/2015
WO 2015106799 A1 7/2015
(Continued)

*Primary Examiner* — Carib A Oquendo
(74) *Attorney, Agent, or Firm* — Dickinson Wright PLLC; Andrew D. Dorisio; Nicholas P. Coleman

(57) ABSTRACT

An apparatus is for installing one or more bolts in a roof of a mine, potentially in an autonomous manner. A sensor captures image data of the roof of the mine. A controller automatically controls a boom associated with a bolter to install the bolts based at least partially on the image data. A system for capturing image data of a mine is also provided, which includes at least one sensor to capture current or present image data of a portion of the mine, such as the roof, and a controller for comparing the current or present image data to previously-collected, pre-existing image data, so as to determine a location in the mine based on the comparison. Related methods are also disclosed.

21 Claims, 8 Drawing Sheets

(56) References Cited

U.S. PATENT DOCUMENTS

| | | | | |
|---|---|---|---|---|
| 2016/0333691 | A1* | 11/2016 | Puura | G01S 7/4865 |
| 2017/0142403 | A1* | 5/2017 | Wang | H04N 13/204 |
| 2018/0298756 | A1 | 10/2018 | Theunissen | |
| 2019/0064820 | A1* | 2/2019 | Boswell | G05D 1/0246 |

FOREIGN PATENT DOCUMENTS

| | | | |
|---|---|---|---|
| WO | 2019046253 | A1 | 3/2019 |
| WO | 2020187947 | A1 | 9/2020 |

* cited by examiner

AUTONOMOUS ROOF BOLTER WITH SENSOR AND RELATED METHODS

This application claims the benefit of U.S. Provisional Patent Application Ser. No. 63/084,238, the disclosure of which is incorporated herein by reference.

TECHNICAL FIELD

This disclosure relates to the underground mining arts and, in particular, to a roof bolter that may utilize sensors for bolt placement, and may operate at least partly, and potentially fully, in an autonomous manner.

BACKGROUND

In underground mining, roof bolters are commonly used to drill holes into the roof and install roof bolts to support the roof. Conditions of the mine may guide or dictate general spacing and placement requirements for roof bolts, such as placement within approximately four to seven feet of one another. With this in mind, mine engineers may design a specific roof control plan which determines the type, size, length, and location of each roof bolt. It is critical that the holes be drilled in the locations specified by the engineer. In addition, roof bolts are used to suspend items such as belt conveyor structure from the roof. Proper operation of the belt conveyor is dependent upon the bolts being installed in precise locations to help ensure proper alignment.

The majority of roof bolters in underground mines are manually operated. Specifically, an operator manually places a drill steel into a dedicated drill head, drills the hole by operating manual controls, and then removes the drill steel. Next, a bolt inserter (wrench) is typically placed in the drill head, and a roof bolt is placed in the bolt inserter. The operator then installs the bolt by operating manual controls to advance the drill head. This process is very labor intensive and relies heavily on the operator's judgment as to a precise location to install roof bolts.

Plates may also be used in connection with roof bolts to aid in supporting the roof. These plates may have many shapes, including square, rectangular, circular, oblong, etc. In some aspects, these plates may be act as washers to assist in securing the bolt within the mine roof and provide further support and stabilization within the mine. Such support provides integrity for the mine roof.

Due to the nature of underground mining environments, the nature of a mine roof is that it tends to not be flat, or at least only be flat in certain areas. This is due to rock, soil, sediment, or any number of factors. Accordingly, a mine roof will tend to have an overall irregular topography.

The manner of placement of a roof bolt and a corresponding plate may often be dictated by a shape or surface topography of the roof of the mine. For example, if a mine roof includes an area that is not flat, or is relatively less flat than surrounding areas, or includes significant protrusions from the roof, it may require significant articulation of a bolter in order to orient said bolter in a proper position for bolt placement according to the roof control plan. Often such determinations of bolter orientation and plate placement must be made on an individual basis based on operator judgment. Such selection is both time consuming and subject to human error in both vision and judgment.

Accordingly, a need is identified for an apparatus, such as a roof bolter, that may utilize sensors for bolt placement, and may operate at least partly, and potentially fully, in an autonomous manner.

SUMMARY

According to a first aspect of the disclosure, an apparatus installing one or more bolts in a mine is provided, which may form part of a mine vehicle. The apparatus includes a boom including a bolter for installing the one or more bolts in the mine. A sensor is adapted to capture image data of a portion of the mine. A controller is adapted to automatically control the boom to install the bolts based at least partially on the image data.

In one embodiment, the controller is further adapted to automatically control the boom based at least partially on a mine roof control plan. The mine roof control plan may comprise a pattern of bolts to be installed, as well as a distance between bolts to be installed.

In one embodiment, the boom includes at least one actuator adapted to rotate and/or extend at least a portion of the boom about at least one rotational axis.

The sensor may be selected from the group comprising a camera, a stereoscopic three-dimensional camera, a computer stereo imager, or a LiDAR-based sensor.

The controller may be adapted to automatically control the boom based on a topography of a roof as the portion of the mine.

Another aspect of the disclosure relates to a system for capturing image data of a mine. The system comprises at least one sensor adapted to capture image data of a portion of the mine. A controller is adapted to compare the captured image data to pre-existing image data of the portion of the mine and determine a location in the mine based on the comparison.

In one embodiment, at least one of the captured image data and the pre-existing image data comprises image data of a plurality of installed roof bolts. In this or other embodiments, at least one of the captured image data and the pre-existing image data comprises image data corresponding to an angular orientation of plates associated with a plurality of installed roof bolts.

At least one of the sensor or the controller may be positioned on a roof bolter. In particular, the sensor may be positioned on the roof bolter and the controller is adapted to determine the location of the roof bolter in the mine.

In one embodiment, the pre-existing image data comprises a map of a roof of the mine based on angular orientation of plates associated with installed roof bolts. A roof bolter may be adapted to collect the pre-existing image data, as well as to install the roof bolts.

This disclosure also pertains to a method of determining a location within a mine. The method comprises capturing image data of a plurality of installed roof bolts or topographical features in the mine. The method further comprises determining a location in the mine based on a comparison of the image data to pre-existing image data.

In one embodiment, the comparing step comprises comparing relative angular orientations of plates of the plurality of installed roof bolts. The pre-existing image data may comprises a map of the roof of the mine based on an orientation of the plates of installed roof bolts.

BRIEF DESCRIPTION OF THE DRAWING FIGURES

The accompanying drawing figures incorporated herein and forming a part of the specification, illustrate several aspects of the disclosed inventions and, together with the description, serve to explain certain principles thereof. In the drawing figures.

Reference will now be made in detail to the present preferred embodiments of the disclosed inventions, examples of which are illustrated in the accompanying drawing figures.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized, and that process or other changes may be made without departing from the scope of the disclosure. The following detailed description is not to be taken in a limiting sense, and the scope of the invention is defined only by the appended claims and their equivalents. In accordance with the disclosure, an automated drilling system is hereinafter described.

Figure 1:
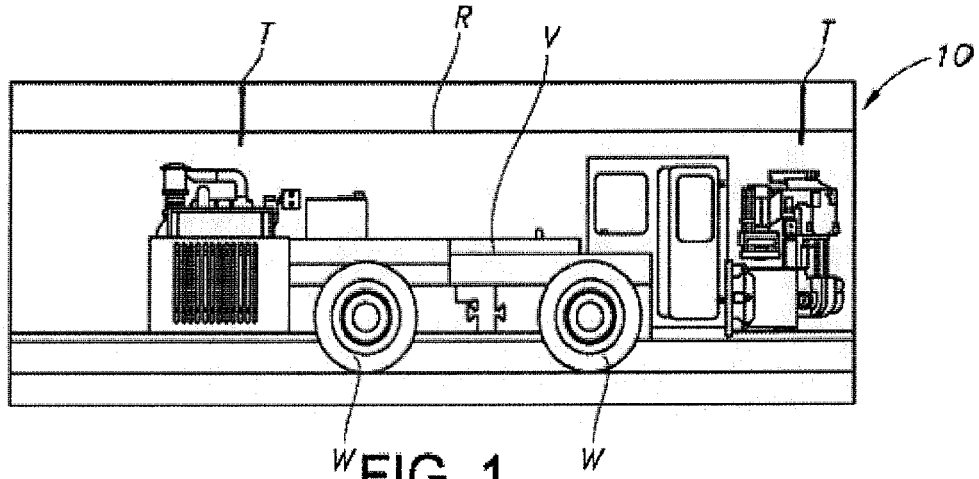
FIG. 1 is a side view of a mine machine, such as a roof bolter.
Figure 2:
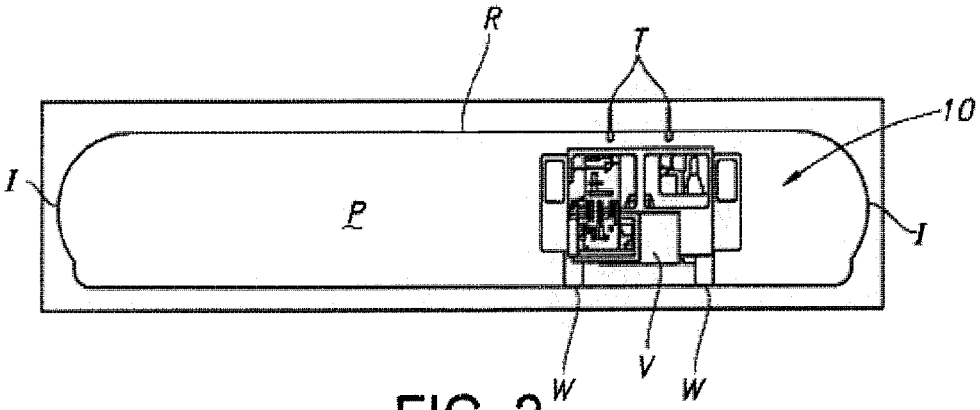
FIG. 2 is an end view of the mine machine.
Figure 3:
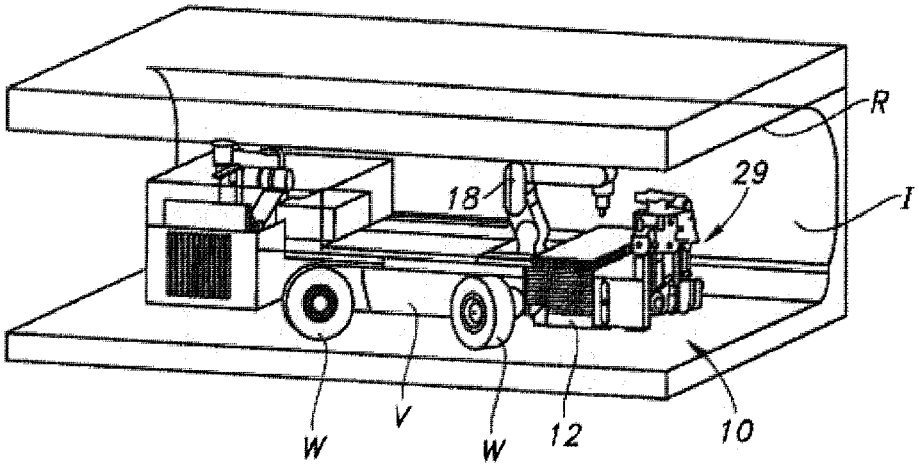
FIG. 3 is a perspective view of the mine machine.

With reference to FIGS. 1-3, a roof bolter 10 is disclosed that may resolve some or all of the foregoing concerns, and possibly others that have yet to be realized. The bolter 10 may comprise a mobile mine vehicle V including ground-engaging structures, such as wheels W, for traversing about a mine passage P and installing roof bolts T into corresponding surfaces thereof, including but not limited to the roof R, as is outlined further in the following description. Despite the use of the term "roof" bolts, it will be understood by skilled artisans that this term is meant to include and cover any anchors for installation in any surface of the mine passage, including the ribs I.

Figure 4:
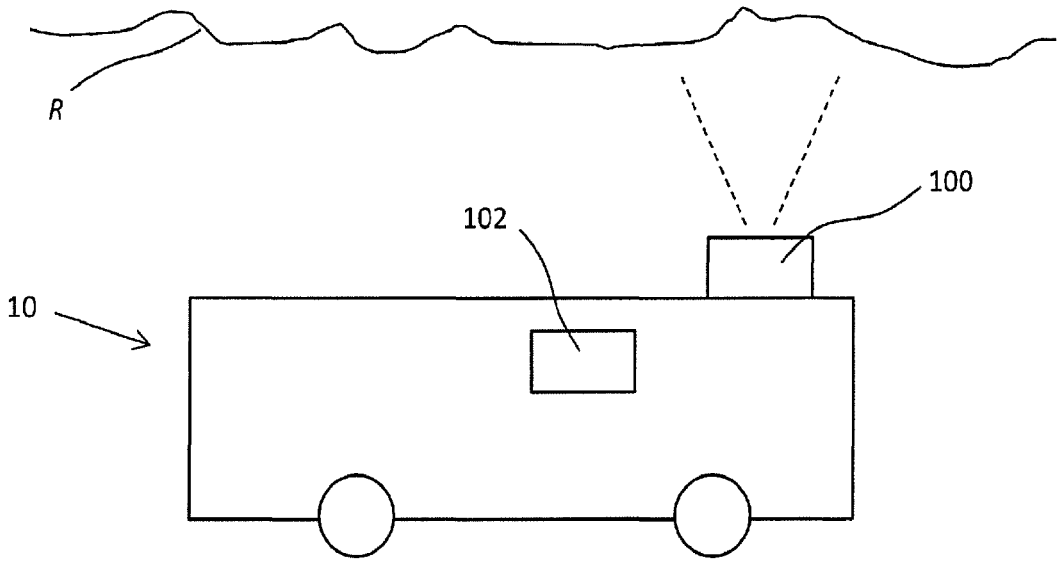
FIG. 4 is a side view of the mining machine including a sensor.

As can be seen in FIG. 4, the roof bolter 10 may include a sensor 100 adapted for sensing an aspect of the environment surrounding the roof bolter. This aspect may include, for example, a topography of a portion of the mine passage P, including the roof R or the rib I. In one instance, the sensor 100 may comprise a camera, such as a stereoscopic three-dimensional camera. In a further aspect, the sensor 100 may comprise other technologies adapted for scanning and/or otherwise evaluating the environment surrounding the roof bolter, such as machine (computer stereo) vision. In another instance, the sensor 100 may be a LiDAR-based sensor.

The sensor 100 may be adapted to survey or model the surface, such as through the use of direct photography. In some embodiments, the sensor 100 may use pulsed laser light, and may survey or model the surface through measurement of reflected pulses of laser light.

As can be seen in FIG. 4, the sensor 100 may be mounted so as to face upward toward the roof of the mine. In some aspects, the sensor 100 may be mounted for articulation to allow for capturing data at different angles within the mine passage.

The sensor 100 may be adapted to create a representation of the environment or the surface, such as a three-dimensional (3D) representation. This 3D representation may be a result of a direct image capture, or may be a compilation of a plurality of two-dimensional (2D) scans of the environment. In one aspect, data captured from the sensor 100 may be used to create a point cloud representation of the surface being scanned.

In one aspect, the sensor 100 may communicate with or be controlled by a controller 102, which may be associated with the roof bolter 10. In some embodiments, the controller 102 may be remote from the roof bolter 10, such as associated with a remote computer. The controller 102 may be adapted to evaluate the data from the sensor 100. In some embodiments, the controller 102 may be adapted for evaluating the data from the sensor 100 and developing the 3D representation. The controller 102 may comprise a computer, a microprocessor, a data storage unit, a GPS, an underground GPS, and/or other local positioning system or device.

Figure 5:
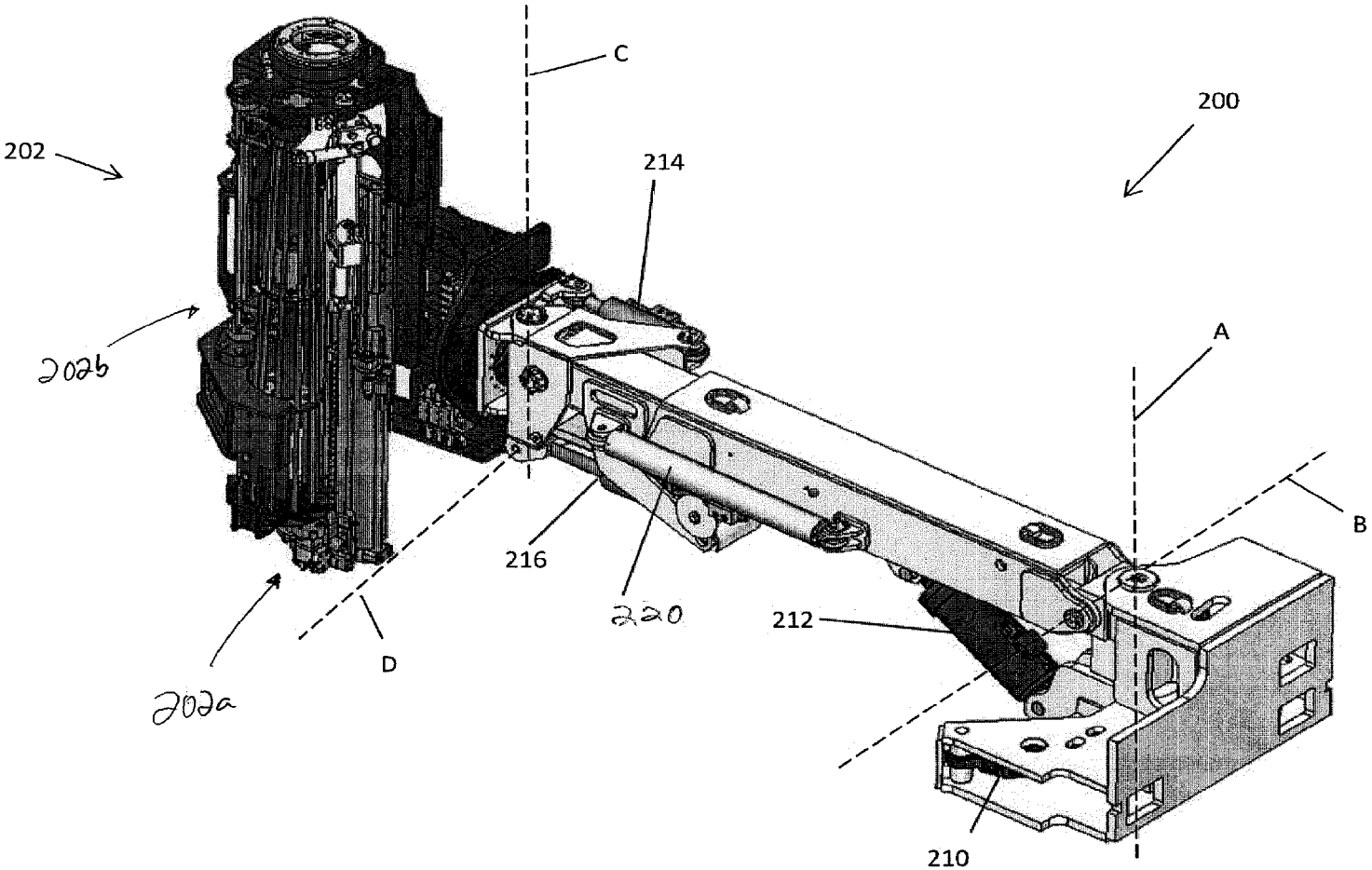
FIG. 5 is a perspective view of a boom with a bolting head.

As can be seen, a surface of the roof R is typically irregular, with various protrusions and recesses therein. Accordingly, as shown in FIG. 5, the roof bolter 10 may be equipped with an articulating boom 200 attached to and supporting a bolter 202, which may include a drill head 202*a* adapted to advance a drill bit or steel to form boreholes, and then retrieve (such as from a carousel 202*b*) and install roof bolts in the roof R of the mine. The articulating boom 200 may be adapted to navigate around various protrusions and recesses in the roof R, thereby positioning the boom 200 in an optimal position to install a bolt in a corresponding surface.

The boom 200 may include one or more actuators adapted to manipulate the position of the bolter 202 for optimal bolt placement. In one aspect, the boom 200 may be adapted to rotate or pivot about one or more axes. In another aspect, the boom 200 may be adapted to extend and retract, such as in a telescoping faction.

Specifically, in the exemplary version illustrated in FIG. 5, the boom 200 may include one or more actuators 210, 212, 214, 216 adapted to rotate or pivot at least a portion of the boom 200. Each actuator 210, 212, 214, 216 may be adapted to rotate or pivot at least a portion of the boom 200 about a different respective axis A, B, C, D, respectively. The axes of rotation A, B, C, D, may be formed by a hinge adapted to allow for rotation of at least a portion of the boom 200. The actuators 210, 212, 214, 216 may comprise hydraulic cylinders, one or more cams, gears, motors, or any other device capable of imparting rotational movement of a portion of the boom 200 about a joint or axis.

The boom 200 may further include another actuator 220 adapted to extend the boom along a longitudinal axis thereof. This actuator 220 may comprise a hydraulic cylinder, one or more cams, gears, motors, or any other device capable of imparting longitudinal movement of at least a portion of the boom along a longitudinal axis thereof. Although illustrated as including only a single extending actuator, the boom 200 may include a plurality of such actuators, including possibly for extending a plurality of telescopic elements of the boom.

In one aspect, the controller 102 may be adapted to automatically articulate the boom 200 based on information gathered from the sensor 100. For example, the controller 102 may be adapted to use a three-dimensional map of the roof R in order to articulate the boom 200 around the various protrusions and recesses therein. This three-dimensional map may be based on a direct capture of a three-dimensional image from the sensor 100, or the controller may be adapted to combine information from multiple images or data captured by the sensor 100 and construct a three-dimensional map based on the multiple images or data.

The controller 102 may be adapted to utilize the three-dimensional map, together with known dimensions of the bolter 202, to determine the optimal placement and orientation of the bolting head 202. Further, the controller 102 may be adapted to automatically articulate one or more of the rotational or extending actuators 210, 212, 214, 216, 220 in order to position and orient the bolting head 202 at the predetermined optimal placement for bolt installation. Automatic articulation of the boom 200 based on the three-dimensional map of the roof R may remove the need for manual manipulation of the bolter 202, thereby improving efficiency and accuracy.

Figure 6:
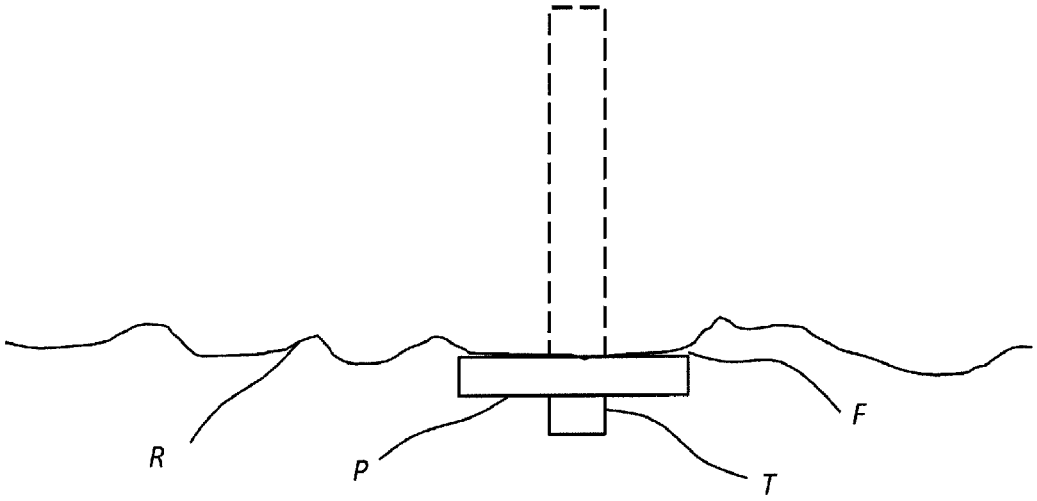
FIG. 6 is a profile view of a roof bolt and a bolt plate installed on a mine roof.

With further reference to FIG. 6, a roof bolt T and a plate P are illustrated installed in the roof R of the mine. As can be seen, a surface of the roof R is irregular, with various protrusions and recesses therein. The plate P is in contact with at least a portion F of the surface of the roof R, thereby increasing stability within the mine.

In a further aspect, the controller 102 may be adapted to determine locations for placing a plurality of roof bolts $T_n$ in the mine roof R. Specifically, the controller 102 may be adapted to automatically place the plurality of roof bolts $T_n$ according to a roof control plan. For example, a first bolt $T_1$ and a first plate $P_1$ may be placed at a first location. This first location may be specified by the roof control plan or may be manually selected by a user. Depending on the roof control plan, a second bolt $T_2$ and a second plate $P_2$ may be positioned with respect to the first location according to said plan.

Figure 7A:
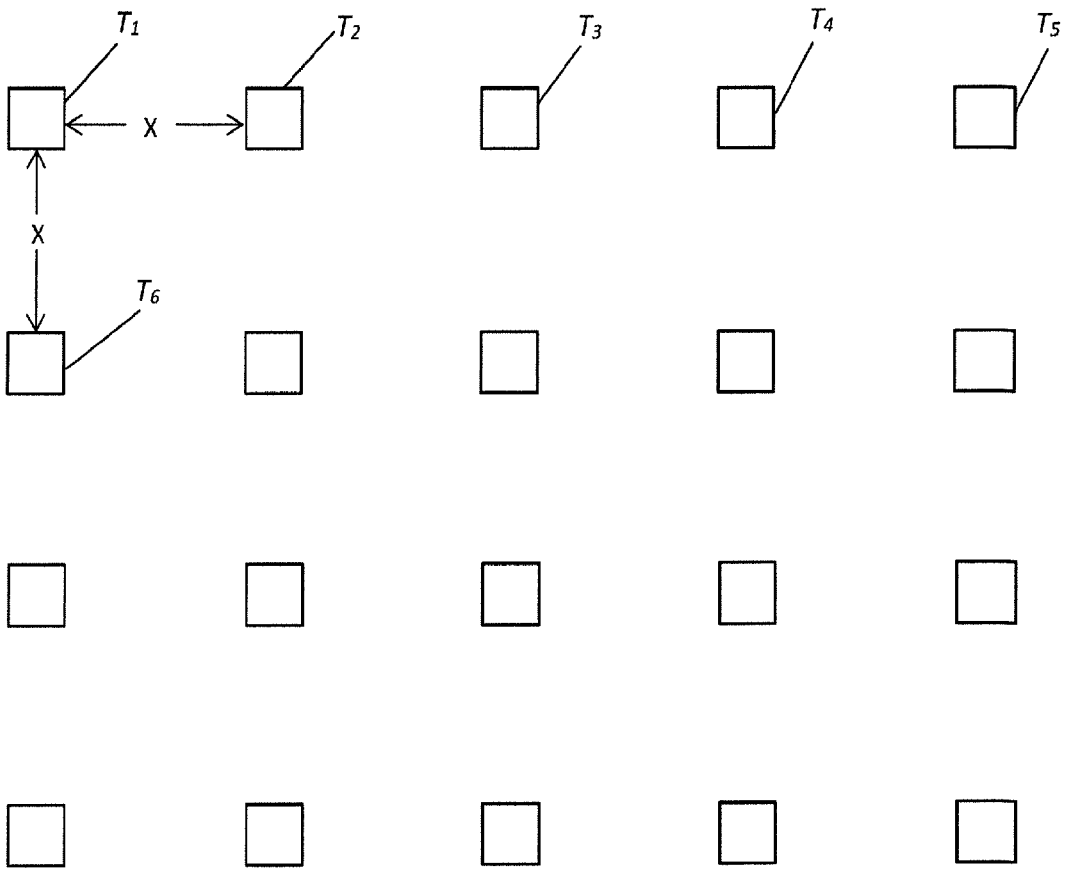
FIGS. 7A and 7B are bottom plan view of patterns of installed bolts in a mine roof.

Roof control plans normally require a distance X between bolts and may also specify a particular bolting pattern. For example, as illustrated in FIG. 7A, a grid pattern of bolts $T_1$-$T_n$ is illustrated, while in FIG. 7B, a staggered pattern is illustrated. Each of FIGS. 7A and 7B illustrate a bottom plan view, looking up at the mine roof, so each illustrated bolt $T_1$-$T_n$ is shown as including a square plate (as the plate has a significantly larger surface area in the plan view than the bolt itself).

In a grid pattern, bolts may be positioned in parallel and perpendicular rows and columns, and each bolt may be a positioned at the distance X between bolts in any of the rows or columns. As illustrated in FIG. 7A, a first row may include five bolts $T_1$-$T_5$ in a first line, each of the bolts "X" distance apart (e.g. 4 feet apart). A second row, beginning with a sixth bolt $T_6$, may be positioned directly adjacent or behind the first row, such that the first bolt in each of the first row and the second row form a column, with subsequent corresponding bolts in each row forming subsequent columns.

Figure 7B:
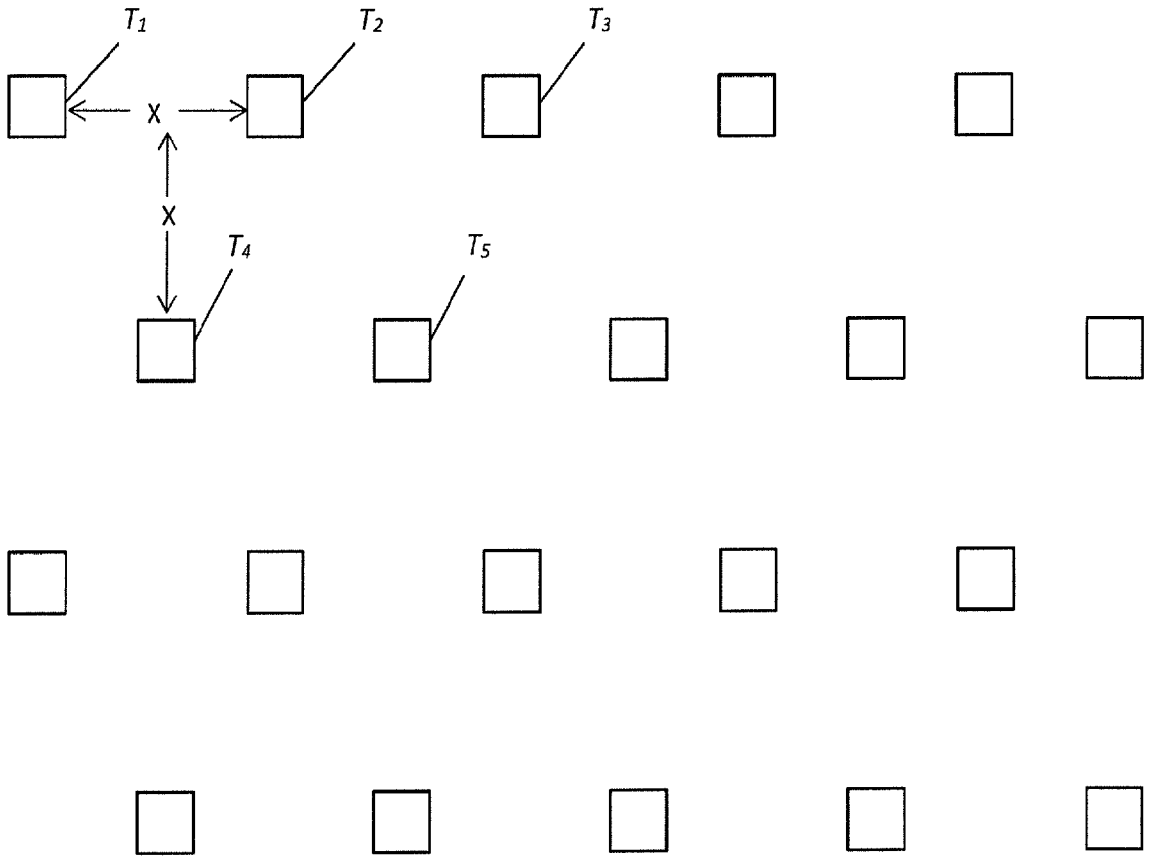

With reference to FIG. 7B, the staggered pattern may begin in a similar fashion as the grid pattern, with bolts $T_1$-$T_3$ of the first row being aligned to form the row, with bolts being spaced "X" distance apart. The second row of the staggered pattern may include bolts $T_4$ and $T_5$, which may also be "X" distance apart from each other. In one aspect, the bolts of the second row may be offset from the bolts in the first row. For example, as shown in FIG. 7B, a fourth bolt $T_4$ may be positioned at a midpoint between the first bolt $T_1$ and a second bolt $T_2$, but offset from that midpoint by the distance "X" in an orthogonal direction. Alternatively, each of the first bolt $T_1$, the second bolt $T_2$, and the fourth bolt $T_4$ may form an equilateral triangle, each equally spaced from the other by the distance "X." In either instance, the remaining bolts may be positioned according to the pattern to form a staggered pattern of roof bolts.

The controller 102 may be adapted to automatically control placement of bolts according to a pattern, such as those previously described. For example, if an operator is able to manually place at least two first bolts at the distance X required by the roof control plan, then those two first bolts necessarily form a line therebetween. The sensor 100 may be able to sense the position of the two first bolts, and based on the desired pattern (e.g. grid or staggered), and the controller 102 may be adapted to place subsequent bolts to form the desired pattern, with the distance X between adjacent bolts as described above.

Figure 8A:
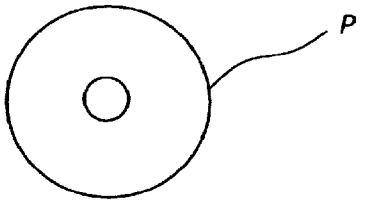
FIGS. 8A-8E are various embodiments of bolt plates.
Figure 8B:
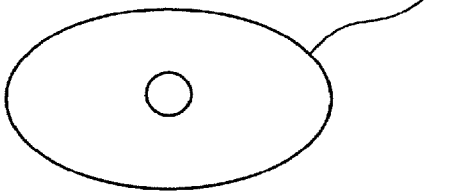
Figure 8C:
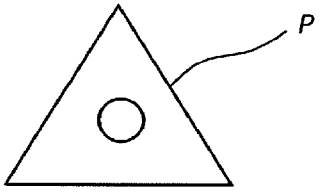
Figure 8D:
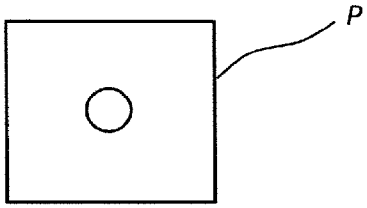
Figure 8E:
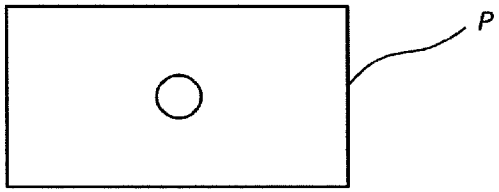

Turning to FIGS. 8A-8E, various profile shapes of plates P are illustrated. For example, the plate P may be circular (FIG. 8A), oblong (FIG. 8B), triangular (FIG. 8C), square (FIG. 8D), or rectangular (FIG. 8E). Various other profile shapes of plates P may be used that are not illustrated, such as polygons, including regular polygons with sides numbering from 5-12 or more. The size of the plate P may be any size capable of providing support for the mine roof R.

In a further aspect of the disclosure, the controller 102 may be adapted to determine a location in a mine based on previously-collected or pre-existing data about the topography of a surface of the mine, such as the mine roof. This topography may include the natural topography of the mine roof itself or data about the roof bolts or roof plates installed thereon. In one instance, this may include determination of location in a mine based only on a topography of a surface of the mine itself. In another instance, this location determination may be based on a given bolt pattern or visual inspection of installed bolts. In a further instance, the location determination may be based on a combination of the topography of the surface of the mine itself and on a given bolt pattern or visual inspection of the installed bolts.

Figure 9:
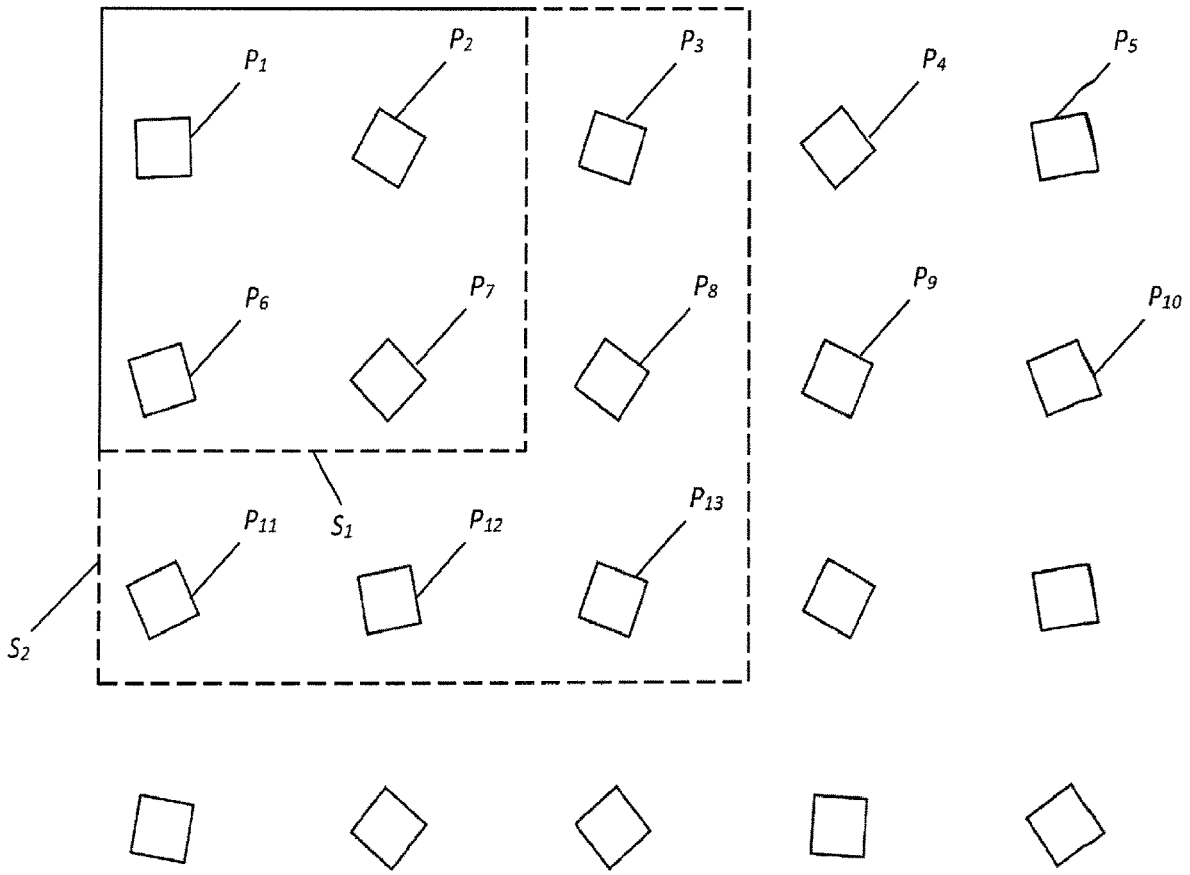
FIG. 9 is a bottom plan view of a plurality of bolt plates installed in a mine roof.

With respect to determining location based on a given bolt pattern or visual inspection of installed bolts or plates, the final angular orientation of a plate once installed in the roof R is random. This is because the installation of the bolt requires rotational movement of the bolt and plate as the bolt is being rotationally inserted (screwed) into the roof R. Therefore, upon complete installation of the bolt into a fixed position in the mine roof, the plate may be oriented at any number of angular positions, depending on the position of the plate as the bolt can no longer be progressed into the roof R. FIG. 9 illustrates a grid pattern of installed bolts in which the plates $P_1$-$P_n$ are shown at various (random) rotational angles. The plates P are illustrated as square plates, but the same random angular orientation of the plates would be true for any shape other than circular plates.

This random orientation of plates is unique to a given location within a mine, precisely because of the random nature of plate orientation upon installation. The infinite number of combinations of angular positioning of adjacent or neighboring plates creates a "fingerprint" of that location within the mine.

After bolts and plates have been installed in a given section of the mine, the sensor 100 may be adapted to obtain data or images of the installed bolts and plates. This collection of installed bolts may be conducted as bolts are installed, such as is described herein, or at any time after bolt installation. The collected images may be separately stored in a database or may be compiled into a comprehensive map of the roof throughout a portion of or the entire mine, and is based on relative angular orientation of plates.

The controller 102 may be adapted to correlate a given image of installed plates to a given position within a mine, according to the fingerprint created by the relative angular positions of installed plates. For example, a given image may correspond to a given position within a tunnel system within the mine. The tunnel system may comprise a separate map which may be overlaid with the comprehensive map of the roof of the mine.

The controller 102 may be adapted to determine its location in a mine based on presently-collected image data from the sensor 100 (i.e. image data collected by the sensor at any given time in the mine) and comparing said presently-collected image data to previously-collected image data related to relative angular plate positioning. This previously-collected image data may comprise the separately stored images in the database or the comprehensive map of the roof of a portion or the entire mine. This may allow the controller 102 to determine the bolter's position in a mine at any given point in the mine in which installed bolt/plate patterns have been imaged and collected.

In order to determine the bolter's current location at any given time, the controller 102 may evaluate present image data (such as from the sensor 100) including the relative angular positions of adjacent or neighboring plates in the vicinity of the bolter. The controller may compare this present image data to previously-collected image data as outlined above. The sensitivity and accuracy of the controller's ability to locate a present position may depend on the size and content of present image data used for the comparison. For example, the controller may be adapted to evaluate present image data including a first row of plates $P_1$-$P_5$. Alternately, the controller may utilize present image data including a first square $S_1$ of a pattern of bolts including four plates, namely plates $P_1$, $P_2$, $P_6$, and $P_7$ of two adjacent rows and columns. In another embodiment, the controller may utilize present image data including a second square $S_2$ of a pattern of bolts including nine plates, namely plates $P_1$, $P_2$, $P_3$, $P_6$, $P_7$, $P_8$, $P_{11}$, $P_{12}$, and $P_{13}$, of three adjacent rows and columns. While these illustrations of FIG. 9 are of a grid pattern of bolts and plates, it will be appreciated that present image data and/or previously-collected image data may include bolts and plates in a staggered or other pattern or arrangement.

The larger the number of plates included in the present image data, the more accurate the positioning determination. For example, if the present image data includes only relative angular orientation of a pair of adjacent plates, it is possible that within the entirety of the mine, there may be multiple pairs of plates that have the same or similar relative angular orientations. However, as the number of plates included in the present image data increases, the likelihood of similar patterns of adjacent or neighboring plates having the same relative angular orientations decreases.

Summarizing, this disclosure may be considered to relate to one or more of the following items in any ordered combination:

1. An apparatus installing one or more bolts in a mine, comprising:
   - a boom including a bolter for installing the one or more bolts in the mine;
   - a sensor adapted to capture image data of a portion of the mine; and
   - a controller adapted to automatically control the boom to install the bolts based at least partially on the image data.

2. The apparatus of item 1, wherein the controller is further adapted to automatically control the boom based at least partially on a mine roof control plan.

3. The apparatus of item 2, wherein the mine roof control plan comprises a pattern of bolts to be installed.

4. The apparatus of any of items 2-3, wherein the mine roof control plan comprises a distance between bolts to be installed.

5. The apparatus of any of items 1-4, wherein the boom includes at least one actuator adapted to rotate at least a portion of the boom about at least one rotational axis.

6. The apparatus of any of items 1-5, wherein the boom includes at least one actuator adapted to extend at least a portion of the boom along a longitudinal axis of the boom.

7. The apparatus of any of items 1-6, wherein the sensor is selected from the group comprising a camera, a stereoscopic three-dimensional camera, a computer stereo imager, or a LiDAR-based sensor.

8. The apparatus of any of items 1-7, wherein the controller is adapted to automatically control the boom based on a topography of a roof as the portion of the mine.

9. A mine vehicle including the apparatus of any of claims 1-8.

10. A system for capturing image data of a mine comprising:
   - at least one sensor adapted to capture image data of a portion of the mine; and
   - a controller adapted to compare the captured image data to pre-existing image data of the portion of the mine and determine a location in the mine based on the comparison.

11. The system of item 10, wherein at least one of the captured image data and the pre-existing image data comprises image data of a plurality of installed roof bolts.

12. The system of item 10 or item 11, wherein at least one of the captured image data and the pre-existing image data comprises image data corresponding to an angular orientation of plates associated with a plurality of installed roof bolts.

13. The system of any of items 10-12, wherein at least one of the sensor or the controller is positioned on a roof bolter.

14. The system of any of items 10-13, wherein the sensor is positioned on the roof bolter and the controller is adapted to determine the location of the roof bolter in the mine.

15. The system of any of items 10-14, wherein the pre-existing image data comprises a map of a roof of the mine based on angular orientation of plates associated with installed roof bolts.

16. The system of any of items 10-15, further including a roof bolter adapted to collect the pre-existing image data.

17. The system of any of items 10-16, wherein the roof bolter is adapted to install the roof bolts.

18. A mine vehicle including the system of any of items 10-17.

19. A method of determining a location within a mine comprising:
   - capturing image data of a plurality of installed roof bolts or topographical features in the mine; and
   - determining a location in the mine based on a comparison of the image data to pre-existing image data.

20. The method of item 19, wherein the comparing step comprises comparing relative angular orientations of plates of the plurality of installed roof bolts.

21. The method of item 19, wherein the pre-existing image data comprises a map of the roof of the mine based on an orientation of the plates of installed roof bolts.

As used herein, the following terms have the following meanings:

"A", "an", and "the" as used herein refers to both singular and plural referents unless the context clearly dictates otherwise. By way of example, "a compartment" refers to one or more than one compartment.

"About," "substantially," or "approximately," as used herein referring to a measurable value, such as a parameter, an amount, a temporal duration, and the like, is meant to encompass variations of +/−20% or less, including +/−10% or less, +/−5% or less, +/−1% or less, and +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Although the invention has been described in conjunction with specific embodiments, many alternatives, modifications, and variations will be apparent to those skilled in the art. Accordingly, it embraces all such alternatives, modifications, and variations that fall within the appended claims' spirit and scope. All publications, patents and patent applications mentioned in this specification are herein incorporated in their entirety by reference into the specification, to the same extent as if each individual publication, patent or patent application was specifically and individually indicated to be incorporated herein by reference. In addition, the identification of any reference in this application shall not be construed as an admission that such reference is available as prior art to the present disclosure.

The invention claimed is:

1. An apparatus installing one or more bolts in a mine, comprising:

a boom including a bolter for installing the one or more bolts in the mine;

a sensor adapted to capture image data of a portion of the mine; and a controller adapted to automatically control the boom to install the bolts based at least partially on the image data, wherein the controller is adapted to automatically control the boom based on a topography of a roof as the portion of the mine.

2. The apparatus of claim 1, wherein the controller is further adapted to automatically control the boom based at least partially on a mine roof control plan.

3. The apparatus of claim 2, wherein the mine roof control plan comprises a pattern of bolts to be installed.

4. The apparatus of claim 2, wherein the mine roof control plan comprises a distance between bolts to be installed.

5. The apparatus of claim 1, wherein the boom includes at least one actuator adapted to rotate at least a portion of the boom about at least one rotational axis.

6. The apparatus of claim 1, wherein the boom includes at least one actuator adapted to extend at least a portion of the boom along a longitudinal axis of the boom.

7. The apparatus of claim 1, wherein the sensor is selected from the group comprising a camera, a stereoscopic three-dimensional camera, a computer stereo imager, or a LiDAR-based sensor.

8. A mine vehicle including the apparatus of claim 1.

9. The apparatus of claim 1, wherein the controller is adapted to determine a location in the mine based on pre-existing data about the topography of the roof.

10. A system for capturing image data of a mine comprising:

at least one sensor adapted to capture image data of a portion of the mine; and a controller adapted to compare the captured image data to pre-existing image data of the portion of the mine and determine a location in the mine based on the comparison.

11. The system of claim 10, wherein at least one of the captured image data and the pre-existing image data comprises image data of a plurality of installed roof bolts.

12. The system of claim 10, wherein at least one of the captured image data and the pre-existing image data comprises image data corresponding to an angular orientation of plates associated with a plurality of installed roof bolts.

13. The system of claim 10, wherein at least one of the sensor or the controller is positioned on a roof bolter.

14. The system of claim 13, wherein the sensor is positioned on the roof bolter and the controller is adapted to determine the location of the roof bolter in the mine.

15. The system of claim 10, wherein the pre-existing image data comprises a map of a roof of the mine based on angular orientation of plates associated with installed roof bolts.

16. The system of claim 10, further including a roof bolter adapted to collect the pre-existing image data.

17. The system of claim 16, wherein the roof bolter is adapted to install the roof bolts.

18. A mine vehicle including the system of claim 10.

19. A method of determining a location within a mine comprising:

capturing image data of a plurality of installed roof bolts or topographical features in the mine; and determining a location in the mine based on a comparison of the image data to pre-existing image data.

20. The method of claim 19, wherein the comparing step comprises comparing relative angular orientations of plates of the plurality of installed roof bolts.

21. The method of claim 19, wherein the pre-existing image data comprises a map of the roof of the mine based on an orientation of the plates of installed roof bolts.

* * * * *